United States Patent [19]

Guha

[11] Patent Number: 4,657,606

[45] Date of Patent: Apr. 14, 1987

[54] HIGH CHROMIUM DUPLEX STAINLESS STEEL

[75] Inventor: Prodyot Guha, High Wycombe, England

[73] Assignee: Bonar Langley Alloys Limited, Slough, United Kingdom

[21] Appl. No.: 816,124

[22] PCT Filed: Apr. 26, 1985

[86] PCT No.: PCT/GB85/00179

§ 371 Date: Dec. 20, 1985

§ 102(e) Date: Dec. 20, 1985

[87] PCT Pub. No.: WO85/05129

PCT Pub. Date: Nov. 21, 1985

[30] Foreign Application Priority Data

Apr. 27, 1984 [GB] United Kingdom ..... 8410859

[51] Int. Cl.[4] ..... C22C 38/42; C22C 38/58

[52] U.S. Cl. ..... 148/327; 148/337

[58] Field of Search ..... 148/37, 38, 327, 332, 148/336, 337; 75/128 A, 125, 128 N, 128 W; 420/57, 58, 59

[56] References Cited

U.S. PATENT DOCUMENTS

| | | | |
|---|---|---|---|
| 3,082,082 | 3/1963 | Bidwell et al. | 75/128 W |
| 3,567,434 | 3/1968 | Richardson et al. | 75/128 A |
| 4,032,367 | 6/1977 | Richardson et al. | 75/128 A |
| 4,591,644 | 5/1986 | Leerschool et al. | 544/200 |

FOREIGN PATENT DOCUMENTS

| | | |
|---|---|---|
| 60577 | 9/1982 | European Pat. Off. . |
| 107489 | 5/1984 | European Pat. Off. . |
| 1158614 | 7/1969 | United Kingdom . |
| 2123437 | 2/1984 | United Kingdom . |

*Primary Examiner*—L. Dewayne Rutledge
*Assistant Examiner*—Deborah Yee
*Attorney, Agent, or Firm*—Dennison, Meserole, Pollack & Scheiner

[57] ABSTRACT

A high chromium, copper containing, duplex steel alloy having a microstructure in which 40% to 60% is a ferritic matrix, the matrix having austenite grains embedded therein, the structure being substantially free of precipitated particles of other phases, and the steel consisting of a balance iron together with the following elements in proportion by weight;

| | |
|---|---|
| Chromium | 23–27% |
| Nickel | 4–7% |
| Molybdenum | 2–4% |
| Silicon | 0.2–2% |
| Carbon | 0.08% maximum; |

and the invention being characterized by controlled additions of:

manganese in an amount of 5% and 7% by weight;

copper in an amount of 1.1% to 3% by weight; to nitrogen in an amount of 0.1% to 0.4% by weight; and the percentage of chromium, plus three times the percentage of molybdenum, being greater than 32%.

2 Claims, No Drawings

HIGH CHROMIUM DUPLEX STAINLESS STEEL

This invention relates broadly to high chromium corrosion resistant duplex steels of the type containing in excess of 23%, and typically 25% by weight of chromium and in excess of 4%, and typically 5% by weight of nickel together with additions of molybdenum and silicon; with less than 0.1% carbon and importantly, with controlled additions of copper, nitrogen and manganese, and with the balance of the composition consisting of iron.

Hitherto, such high chromium duplex steels are always produced such that after melting, casting and in some cases, hot working, and in other cases, welding, the alloy is subjected to solution heat treatment in the temperature range 1050° C. to 1150° C. This, in the case of steels as described in British Patent specification No. 1,158,614, is often carried out for at least one hour per inch of cross-section, and sufficient to produce a product which is substantially free of precipitated particles and of which 40% to 60% (by weight) is a ferritic matrix, the matrix having austenite grains embedded therein.

Such heat treatment is followed by rapid quenching in oil or water. Resistance to corrosion, in combination with good strength and ductility, can only be maximized in such duplex steels, if, after casting, hot working or welding, they are subjected to this solution heat treatment followed by rapid cooling whereby deleterious precipitates are taken into solution, and retained in solution, during cooling to room temperature.

Typically, in the solution heat treated condition, an alloy as described for example, in British Patent specification No. 1, 158 614, will achieve mechanical properties as follows:

| | |
|---|---|
| 0.2% Proof Stress - tons/sq. in | 28 |
| Ultimate tensile strength - tons/sq. in. | 48 |
| Elongation - % | 25 |
| Impact Value - Joules | 50 |

These mechanical properties are achieved, together with good resistance to corrosion, in both acidic and salt water conditions.

A well known measure of resistance to corrosion is the standard test for resistance to pitting corrosion in the 3% sodium chloride solution at 30° C., using a saturated calomel electrode (S C E), where the voltage is measured, at which breakdown occurs of the passive oxide film protecting such steels; and where higher breakdown potentials indicate better pitting corrosion resistance.

In a typical duplex steel according to G.B. Patent specification No. 1,158 614, in the solution heat treated condition, such breakdown does not occur until a potential in excess of 800 millivolts is reached. However in the case of an identical alloy, which has not been solution heat treated, a breakdown in the passive film may occur at potentials as low as 100 millivolts.

Such a non solution heat treated duplex steel will have mechanical properties, typically as follows:

| | |
|---|---|
| 0.2% Proof Stress - tons/sq. in. | 30 |
| Ultimate Tensile Strength - tons/sq. in. | 50 |
| Elongation - % | 17 |

-continued

| | |
|---|---|
| Impact values - Joules | 20 |

It can therefore be seen that if the known high chromium duplex steels are not so solution heat treated and then rapidly cooled, they fail to achieve the required degree of ductility, and in important combination therewith, resistance to corrosion.

However, the need for such solution heat treatment followed by rapid cooling incurs a number of disadvantages, for example as follows:

(1) Such heat treatment often has to be carried out after welding and this causes difficulty in the case where the steel is located at the site of final use; for example after welding the alloy at an offshore installation it is impractical to carry out solution heat treatment.

(2) Moreover, when defects, discovered during machining, are rectified by a weld, it would be clearly disadvantageous if a further heat treatment had to be carried out on a component in the finished machined condition.

(3) The solution heat treatment followed by rapid cooling involves the risk of excessive stresses being created in the duplex steel and this may have disadvantages in the case of for example large or complex weld fabrications or in large forged shafts.

Accordingly it will clearly be beneficial in some cases if these high chromium duplex steels, with their superior resistance to corrosion, particularly in chloride environments can be produced without the necessity of always having to subject the alloy to solution heat treatment followed by rapid cooling. It will be advantageous if the alloy can be used in the as-cast or as-welded condition, or in the as-hot-worked condition, e.g. as hot rolled, with no further solution heat treatment and rapid cooling being needed.

Specifically, a requirement exists for a duplex steel which has the following combination of strength, ductility and resistance to pitting corrosion, in the as cast and in the as cast and hot worked conditions, both without solution heat treatment:

| Condition | As Cast | Hot Worked |
|---|---|---|
| 0.2% Proof Stress Tons/sq. in | 30 | 30 |
| Ultimate Tensile Strength - Tons/sq. in | 50 | 50 |
| Elongation % | 25 | 18 |
| Impact Value, Joules | 30 | 30 |
| Pitting Corrosion Breakdown Potential (SCE - 3% NaCl Soln. at 30° C.) in millivolts | 800 | 500 |

If such a duplex steel can be achieved then it will be advantageous if it will respond to solution heat treatment, in cases where such further heat treatment is practical. It will be further advantageous if, after such solution heat treatment, the alloy can be cooled in air rather than having to be rapidly cooled by quenching in oil or water. It is also desirable for very heavy sections, say 10 cm and above, that the alloy should have adequate ductility to permit water quenching to be applied, without cracking. Finally it will be advantageous if the alloy does not always require further solution heat treatment after welding.

The present invention has for its object to provide an alloy, which largely satisfies these objectives.

Accordingly, this invention provides a high chromium, copper containing, duplex alloy steel, having a microstructure in which 40% to 60% is a ferritic matrix, the matrix having austenite grains embedded therein, and the steel consisting of iron together with the following elements in proportion by weight:

| | |
|---|---|
| Chromium | 23–27% |
| Nickel | 4–7% |
| Molybdenum | 2–4% |
| Silicon | 0.2–2% |
| Carbon | 0.08% maximum, |

and importantly, the steel alloy according to this invention contains controlled additions of:

manganese in an amount of 5% to 7% by weight; and preferably not more than 6.2%, copper in an amount of 1.1% to 3% by weight; and nitrogen in an amount of 0.1% to 0.4% by weight; with the percentage of chromium, plus three times the percentage of molybdenum, being greater than 32%

It has been found that the nitrogen content is beneficial for enhancing resistance to corrosion and in particular, the resistance to pitting corrosion, as well as enhancing ductility.

The copper content has been found to enhance the ductility of the alloy in the condition as cast, or as hot worked (both without heat treatment).

The addition of 5% to 7% of Manganese appears also to enhance the ductility in this nitrogen and copper containing high chromium duplex steel and it is believed that this may be accomplished by retarding the formation of the brittle sigma phase, in the temperature range 700° to 950° C. (which phase reduces resistance to corrosion in sea water), as well as retarding the formation of the alpha prime phase, in the temperature range 300° to 500° C.

The alloy according to the invention is essentially a duplex stainless steel consisting of approximately 50/50 ferrite/austenite ratio, which ensures the high strength and surerior pitting resistance of similar high chromium duplex stainless steels. If the manganese content is increased above 7% there would be a significant increase in the austenite content, resulting in loss of strength and pitting resistance of the alloy.

Manganese is usually added to stainless steels in amounts up to about 2% by weight, its main function being to combine with deleterious elements such as oxygen and sulphur. Austenitic steels of high chromium content having manganese contents of about 4% by weight have been produced and such high manganese austenitic steels possess somewhat higher strength and resistance to pitting corrosion that conventional austenitic steels.

Manganese and Nickel are austenite formers and according to generally accepted principles deriving from Schaeffler, manganese is half as effective as nickel in this function. In the high chromium duplex steels containing Nitrogen and Copper as described in GB Specn. No. 1 158 617, referred to at the outset, experience has shown that optimum resistance to pitting corrosion in chloride environments occurs when the microstructure of the steel exhibits similar amounts of ferrite and austenite; that is when its microstructure has a 40% to 50% ferrite matrix, the matrix having austenite grains embedded therein. In a steel having 25% Chromium this ratio occurs with a Nickel content of about 5% while in a steel with 28% Chromium this ratio occurs with a Nickel content of about 8% by weight.

According to Schaeffler principles manganese is half as effective as nickel as a former of austenite. However, it has been found that this equivalence does not apply to steels according to the present invention. For example, if 8% Nickel is added to a steel with 25% chromium, poor resistance to pitting corrosion is obtained and the austenite content is found to increase to about 80%. Surprisingly however, if to such a steel having high chromium (25%), there is added manganese in its nickel "equivalent" amount, plus nickel proper, to give a nickel "equivalent" of 8%, according to Schaeffler principles, that is say 5% nickel plus about 6% manganese, then it will be found that the austenite content does not significantly increase, while the resistance to pitting corrosion remains at the optimum level. However, the significant Manganese content, which is now at about 6%, is found to provide a steel which can be used in the as-cast, as-hot-rolled or as-welded condition without the need for further solution heat treatment.

The compositions, mechanical properties, and resistance to pitting corrosion in sea water of a number of steels are shown in the following Tables.

Table I lists the compositions of the alloys tested. The duplex alloys 1 to 5, employed for comparison, are steels with nitrogen and copper additions within the ranges specified in British Patent Specification No. 1 158 614; however, these duplex alloys differ from the invention in having less than 4.5% by weight of Manganese. The alloys according to this invention, exemplified in Melts M.1, M.2 and M.3, on the other hand have the higher manganese content now suggested.

Table II shows, firstly, that Melt M.1, with added manganese has enhanced ductility in the as-cast condition as compared with Melts 1 and 2. In the as-cast condition the steel M.2, with the manganese addition in the amount specified according to this invention, exhibited an excellent combination of mechanical properties when in the as-cast condition (i.e. without any heat treatment) as compared with the comparable alloys.

When duplex alloys with low manganese contents are hot worked from temperatures between 1050°–1150° C. the resultant product has to be subjected to solution heat treatment. The alloy, Melt M.3, with a manganese content of above 5% by weight, can be used in the as-hot-worked condition and does not have to be solution heat treated. This can be of significant advantage, for the production of long shafts and critical applications as high strength materials. These might otherwise suffer from non-symmetrical relaxation and distortion due to the residual internal stresses, when layers of externalmaterial are removed during machining.

Although the main object is to provide an alloy which does not require solution heat treatment, nevertheless, the high manganese alloys do respond to such solution heat treatment, followed by rapid cooling, as will be noted from Tables II, III and VII. From Tables II and III, it will be seen that the Melts M.2 and M.3 while achieving an adequate combination of good corrosion resistance and mechanical properties, both in the as-cast and as-hot-worked conditions and without heat treatment and rapid cooling, nevertheless responded with even better properties when subjected to heat treatment and rapid cooling. While from Table VII, it can be seen that the cast alloy steel M4 responded to heat treatment and rapid cooling, while having, in the air cooled condition better resistance to corrosion as compared with the alloy Melt No. 6.

This response is of importance since while small section castings of the alloy containing more than 5% Manganese have been found to possess good mechanical properties and adequate corrosion resistance for service in most chemical plant environments, nevertheless the pitting and crevice corrosion resistance of the alloy, in some critical marine environments, although superior to the alloys with lower Manganese, may still be inadequate. Solution heat treatment at 1120° C. followed by rapid cooling is necessary in these cases.

However, when such a heat treated small section casting is subsequently welded, provided that a high Manganese alloy according to this invention is used as the weld material, then no further post weld heat treatment is necessary.

The reason is that the weld metal cools evenly and is itself, in effect, of small section; as a consequence there is little likelihood of differential cooling taking place.

Table V gives the results for tests of resistance to corrosion in a 70% solution of suphuric acid at 60° C., the results being given in mdd (milligrams per square decimeter per day)

Results of testing for weldability are given in Table VI.

Duplex alloys with Manganese contents lower than 4.5% by weight, have to be water or oil quenched after solution heat treatment at 1120° C. to ensure optimum combination of mechanical properties and corrosion resistance. By contrast, the alloy containing in excess of 5% Manganese can be air cooled after solution heat treatment at 1120° C. with resultant good mechanical properties and corrosion resistance. As a result of quenching from 1120° C. castings of intricate design and varying section thicknesses can suffer from distortion, and often modification of casting design or heat treatment procedure is necessary. If castings can be air cooled after solution heat treatment without sacrifice of corrosion resistance, production of complicated castings is significantly eased.

It should be noted that water quenching, following solution heat treatment, produces internal stresses in the wrought or cast components because the outer layers tend to cool more rapidly and hence contract more rapidly than the inner layers. If such components then have to be machined, non-symmetrical relaxation of stresses as the outer layers of material are removed, tends to produce distortion. In order to overcome this problem, a complex sequence of machining, press straightening and stress relieving operations has hitherto been required. The ability to use air cooling following solution heat treatment largely avoids these problems because thermal stresses have time to relax during the slower cooling rates employed.

When duplex alloys with low Manganese contents are heated above 1000° C. and then cooled in air, as occurs in the heat affected zones during welding, a post weld solution heat treatment is necessary to restore the alloys corrosion resistance. This is often impractical if weld repair is necessary to rectify defects revealed during final machining, or when components have to be welded into manufacturing plant in-situ.

The alloy with 5 to 7% manganese, when air cooled, from such temperatures has adequate corrosion resistance and can be used without the necessity of solution heat treatment after welding.

TABLE I

| Melt No | Composition, Weight % | | | | | | | |
|---|---|---|---|---|---|---|---|---|
| | Cr | Ni | Mo | Cu | Si | C | $N_2$ | Mn |
| 1 | 25.2 | 5.2 | 2.6 | 2.5 | 1.1 | 0.06 | 0.17 | 1.0 |
| 2 | 24.3 | 5.0 | 2.5 | 1.8 | 0.9 | 0.07 | 0.20 | 2.8 |
| 3 | 25.2 | 5.3 | 2.51 | 2.6 | 1.1 | 0.07 | 0.17 | 0.98 |
| 4 | 25.4 | 5.2 | 2.6 | 1.9 | 0.5 | 0.06 | 0.16 | 0.82 |
| 5 | 24.9 | 5.3 | 2.52 | 2.7 | 1.1 | 0.06 | 0.18 | 2.92 |
| 6 | 26.3 | 5.20 | 2.60 | 1.80 | 0.48 | 0.04 | 0.17 | 4.40 |
| | (Alloys with added MANGANESE) | | | | | | | |
| M.1 | 23.8 | 4.8 | 2.3 | 1.7 | 1.0 | 0.05 | 0.18 | 6.00 |
| M.2 | 25.1 | 5.1 | 2.58 | 2.8 | 1.2 | 0.07 | 0.18 | 5.10 |
| M.3 | 24.2 | 4.8 | 2.35 | 1.63 | 0.5 | 0.05 | 0.18 | 6.02 |
| M.4 | 25.6 | 5.29 | 2.59 | 1.77 | 0.45 | 0.06 | 0.17 | 5.30 |

TABLE II

Mechanical Properties

| MELT | Condition/ Treatment | 0.2% PS Tons/ sq. in | U.T.S. Tons/ sq. in | % Elongation | Impact Value Joules |
|---|---|---|---|---|---|
| | CASTINGS 2.5 cm diameter cast bars | | | | |
| 1 | As cast (no heat treatment) | 37.2 | 51.4 | 18.0 | — |
| 2 | As cast | 31.2 | 48.7 | 26.0 | — |
| M.1 | As cast | 33.8 | 53.4 | 30.0 | — |
| 3 | As cast (no heat treatment) | 31.5 | 51.5 | 17 | 20 |
| | 1120° C. W.Q. | 31 | 50.5 | 30 | 110 |
| | 1120° C. W. Q. + 4 hrs @ 500° C. | 38.5 | 57.5 | 25 | 54 |
| 5 | As-cast (no heat treatment) | 31 | 50.5 | 18 | 27 |
| | 1120° C. W.Q. | 31 | 51 | 30 | 122 |
| | 1120° C. W.Q. + 4 hrs @ 500° C. | 36.5 | 55.5 | 25 | 67 |
| M.2 | As-cast (no heat treatment) | 30.5 | 51 | 25 | 34 |
| | 1120° C. W.Q. | 30 | 49.5 | 32 | 130 |
| | 1120° C. W.Q. + 4 hrs @ 500° C. | 35.5 | 53 | 27 | 80 |
| | ROLLED BARS | | | | |
| MELT No | | 0.2% PS Tons/ sq. in | U.T.S. Tons/ sq. in | % Elongation | Impact Value Joules |
| | 2.5 cm diameter | | | | |
| 4 | As Rolled + 4 hrs @ 500° C. | 53 | 65 | 26 | 48 |
| | 1120° C. W.Q. | 30.5 | 50.5 | 32 | 122 |
| | 1120° C. W.Q. + 4 hrs @ 500° C. | 40.5 | 58.5 | 26 | 67 |
| M.3 | As Rolled + 4 hrs @ 500° C. | 35 | 54 | 18 | 35 |
| | | 51.5 | 62 | 27 | 54 |
| | 1120° C. W.Q. | 30.5 | 49 | 33 | 130 |
| | 1120° C. W.Q. + 4 hrs @ 500° C. | 34.5 | 53.5 | 30 | 122 |
| | 7.5 cm diameter | | | | |
| 4 | 1120° C. W.Q. | 31 | 51 | 30 | 122 |
| | 1120° C. W.Q. + 4 hrs @ 500° C. | 41 | 58 | 25 | 67 |
| M.3 | 1120° C. W.Q. | 29.5 | 49.5 | 33 | 130 |
| | 1120° C. W.Q. + 4 hrs @ 500° C. | 36.5 | 53 | 30 | 122 |

PS = Proof Stress
UTS = Ultimate Tensile Strength
WQ = Water Quenched

TABLE III

PITTING CORROSION RESISTANCE
POTENTIOSTATIC TEST IN 3% NaCl Solution @ 30° C.
(SATURATED CALOMEL ELECTRODES)

| Melt No | Condition | Pitting Potential at breakdown of static film in millivolts |
|---|---|---|
| | 2.5 cm diam cast bar | |

TABLE III-continued

| PITTING CORROSION RESISTANCE POTENTIOSTATIC TEST IN 3% NaCl Solution @ 30° C. (SATURATED CALOMEL ELECTRODES) | | |
|---|---|---|
| Melt No | Condition | Pitting Potential at breakdown of static film in millivolts |
| 3. | As cast | +100 m.V. |
| | 1120° C. W.Q. | +850 m.v. |
| | 1120° C. W.Q. + 4 hrs @ 500° C. | +850 m.V. |
| M.2. | As cast | +800 m.V. |
| | 1120° C. W.Q. | +850 m.V. |
| | 1120° C. W.Q. + 4 hrs @ 500° C. | +850 m.V. |
| | 2.5 cm diam rolled bars | |
| 4. | As rolled | +100 m.V. |
| | Rolled + 4 hrs @ 500° C. | +100 m.V. |
| | 1120° C. W.Q. | +850 m.V. |
| | 1120° C. W.Q. + 4 hrs @ 500° C. | +850 m.V. |
| M.3. | As rolled | +700 m.V. |
| | +4 hrs @ 500° C. | +650 m.V. |
| | 1120° C. W.Q. | +850 m.V. |
| | 1120° C. W.Q. + 4 hrs @ 500° C. | +850 m.V. |
| (S.C.E.) | | |
| | 7.5 cm dia rolled bar | |
| 4. | As rolled | +100 m.V. |
| | 1120° C. W.Q. | +850 m.V. |
| | 1120° C. W.Q. + 4 hrs @ 500° C. | +850 m.V. |
| M.3. | As rolled | +500 m.V. |
| | 1120° C. W.Q. | +850 m.V. |
| | 1120° C. W.Q. + 4 hrs @ 500° C. | +850 M.V. |

WQ = Water Quenched

TABLE IV

| Pitting Corrosion Resistance in 3% NaCl at 30° C., with Applied Potential of 600 mv (S.C.E) - no heat treatment | |
|---|---|
| Melt 1 | |
| 2.5 cm diameter bar - as cast | poor |
| 7.5 cm-diameter bar - as rolled | poor |
| Melt 2 | |
| 2.5 cm diameter bar - as cast | good |
| 7.5 cm diameter bar - as rolled | poor |
| Melt M.1 | |
| 2.5 cm diameter bar - as cast | good |
| 7.5 cm diameter bar - as rolled | good |

TABLE V

| Immersion Corrosion Tests in 70% $H_2SO_4$ @ 60° C. | | |
|---|---|---|
| | 2.5 cm dia cast bar | m.d.d. |
| Melt 3 | As cast | 650 |
| | 1120° C. W.Q. | 450 |
| | 1120° C. W.Q. + 4 hrs @ 500° C. | 530 |
| Melt M.2 | As cast | 450 |
| | 1120° C. W.Q. | 500 |

TABLE V-continued

| Immersion Corrosion Tests in 70% $H_2SO_4$ @ 60° C. | |
|---|---|
| 2.5 cm dia cast bar | m.d.d. |
| 1120° C. W.Q. + 4 hrs @ 500° C. | 450 |

mmd = milligrams sq. decimeter/day

TABLE VI

| Weldability Test | | |
|---|---|---|
| | Condition | |
| Melt 3 | As cast | Cracked |
| | 1120° W.Q. | Satisfactory |
| Melt 5 | As cast | Cracked |
| | 1120° C. W.Q. | Satisfactory |
| Melt M.2 | As cast | Satisfactory |
| | 1120° C. W.Q. | Satisfactory |

TABLE VII

| PITTING CORROSION RESISTANCE POTENTIOSTATIC TEST IN 3% NaCl Solution @ 30° C. (SATURATED CALOMEL ELECTRODES) Pitting Potential at breakdown of static film in millivolts | | |
|---|---|---|
| | Melt No. | |
| Condition/Treatment | M.4 | 6 |
| As cast, and heated to 1120° C. then: | | |
| Air Cooled | +940 mV. | +80 mV |
| Water Quenched | +950 mV. | +950 mV |
| Air Cooled + 4 hrs @ 500° C. | +900 mV. | +50 mV |
| Water Quenched + 4 hrs @ 500° C. | +950 mV. | +900 mV |

I claim:

1. A high chromium, copper containing duplex steel alloy having a microstructure in which 40% to 60% is a ferritic matrix, the matrix having austenite grains embedded therein, the structure being substantially free of precipitated particles of other phases, and the steel consisting of a balance of iron together with the following elements in proportion by weight:

| | |
|---|---|
| Chromium | 23–27% |
| Nickel | 4–7% |
| Molybdenum | 2–4% |
| Silicon | 0.2–2% |
| Carbon | 0.08% maximum; |

and the invention being characterized by controlled additions of:

manganese in an amount of 5% to 7% by weight;
copper in an amount of 1.1% to 3% by weight; and
nitrogen in an amount of 0.1% to 0.4% by weight;
and the percentage of chromium, plus three times the percentage of molybdenum, being greater than 32%, said alloy having good resistance to pitting corrosion both in the as-cast condition and after solution heat treatment.

2. A steel according to claim 1, wherein the Manganese content does not exceed 6.2% by weight.

* * * * *